US006140908A

United States Patent [19]

Choi

[11] Patent Number: 6,140,908

[45] Date of Patent: Oct. 31, 2000

[54] FOCUS VOLUME COUPLING DEVICE OF FBT

[75] Inventor: Dae Sung Choi, Kyungki-do, Rep. of Korea

[73] Assignee: Samsung Electro-Mechanics Co., Ltd., Kyungki-do, Rep. of Korea

[21] Appl. No.: 09/276,593

[22] Filed: Mar. 25, 1999

[51] Int. Cl.[7] ..... H01C 10/32

[52] U.S. Cl. ..... 338/162; 338/226

[58] Field of Search ..... 338/226, 232, 338/252, 267, 301, 279, 283, 293, 290, 307, 162, 163, 164

[56] References Cited

U.S. PATENT DOCUMENTS

| | | | |
|---|---|---|---|
| 2,367,170 | 1/1945 | Fahrenwald | 219/540 |
| 3,543,213 | 11/1970 | Weyenberg | 338/290 |
| 3,860,789 | 1/1975 | Maake | 219/532 |
| 4,829,282 | 5/1989 | Waugh et al. | 338/279 |
| 5,789,703 | 8/1999 | Choi | 174/50.62 |
| 5,859,407 | 1/1999 | Saiki et al. | 338/307 |

FOREIGN PATENT DOCUMENTS

| | | | |
|---|---|---|---|
| 4-348501 A | 12/1992 | Japan | 338/22 R |
| 1998-023180 | 6/1988 | Rep. of Korea . | |

*Primary Examiner*—Michael L. Gellner
*Assistant Examiner*—Kyung S. Lee
*Attorney, Agent, or Firm*—Renner, Otto, Boisselle & Sklar, LLP

[57] ABSTRACT

A focus volume of an FBT (fly back transformer) focus unit and its coupling device are disclosed, in which a volume board is provided in a small size, but the voltage breakdown resisting strength is reinforced. At least one or more round resistor patterns 130 are formed on a volume board 120 which is installed within a focus volume 100 of the FBT focus unit 110. An opening 140 is formed within each of round portions of the resistor patterns 130, and a volume case 180 has a pair of isolating walls 160 within its interior 170, for being inserted into the opening 140 of the volume board 120. The volume case 180 is installed on a side of an FBT case 150. Thus the volume board is made to have a small size, but its voltage breakdown resisting strength is reinforced. Therefore, the filling of an epoxy resin is not required, thereby simplifying the manufacturing process, and making it easy to manufacture the product.

14 Claims, 7 Drawing Sheets

FOCUS VOLUME COUPLING DEVICE OF FBT

BACKGROUND OF THE INVENTION

1. Field of the Invention

The present invention relates to a fly back transformer (to be called "FBT" below) which generates a high voltage to be supplied to a cathode ray tube of a TV or a monitor. Particularly, the present invention relates to a focus volume of an FBT and its coupling device, in which a volume board of a focus unit of the FBT is provided in a small size, but its voltage breakdown resisting strength is reinforced. More specifically, the present invention relates to a focus volume of an FBT and its coupling device, in which a resistor pattern having at least one or more round portions with a moving variable contact is formed on a volume board, and the volume board is installed on the focus unit of the FBT. Further, the volume board is open, and the opening covers the center of a virtual circle extending along the round portion of the resistor pattern and also covers a part of a virtual straight line connecting the starting point and the ending point of the round portion. Therefore, when manufacturing the focus volume of the focus unit (which is installed on a side of the FBT case), the focus ceramic board can be separately manufactured, and then, the volume resistor pattern can be printed. Thus the volume board is provided in a small size, but its voltage resisting strength is reinforced. Further, the manufacturing process for the volume board is simplified, and the epoxy resin needs not be filled. Therefore, the volume board can be manufactured in an easy manner. Further, one ceramic board can serve as a small and large volume board, and therefore, the volume board can be standardized.

2. Description of the Preferred Embodiment

In the generally known conventional FBT, high and low voltage bobbins which are installed within the FBT case generate a high voltage to supply it through an anode cable to a cathode ray tube of TV or monitor. Here, the focus unit which is installed on a side of the FBT case varies the focus and screen voltages.

FIG. 1 illustrates the conventional focus unit of the FBT. Referring to FIG. 1, a focus volume knob 30 is integrally formed with a rotating piece 40 which extends into a main body 20 of a focus unit 10. Upon the rotating piece 40, there is installed a slider 50. Upon the slider 50, there is installed a ceramic board 70 on which a resistor pattern 60 having a variable contact and a central contact is printed, the variable contact and the central contact being connected to the contacts of the slider 50. A soft insulating resin 21 is coated upon the ceramic board 70 which has the resistor pattern.

In this conventional focus unit 10 constituted as described above, in order to step up or down the focus and screen voltages, if the focus volume knob 30 (extending to the outside of the main body 20) is manually turned, the slide 50 together with the rotating piece 40 is rotated, so that the voltages can be stepped up or down along the resistor patterns 60 of the ceramic board 70.

Meanwhile, FIG. 2 illustrates the ceramic board (volume board) for use in the conventional focus unit 10. Referring to this drawing, in the resistor pattern 60, a contact point 61 of the slider 50 lies between a shaft 63 of an output focus voltage 62 and the round resistor pattern 60. The contact point of the slider 50 rotates around the shaft 63 and along the contact point 61.

Under this condition, if a high voltage of about 5–10 KV is inputted into an input terminal 67, the high voltage is supplied to between the input terminal 67 and a ground 66, while an output focus voltage 64 is transmitted through the contact point 61 which rotates around the shaft 63. An output screen voltage 65 also is related to a contact point 61' and a shaft 69 in the same manner, and a stepped-down voltage is transmitted through the contact point 61'.

However, owing to the contact point 61 sweeping along the round resistor pattern 60, there is generated a potential difference between the round resistor and the output focus 64. The distance between the resistor of the output focus 64 and the round resistor pattern 60 becomes an important factor for the voltage breakdown resisting strength.

Particularly, the size of the round resistor pattern 60 cannot be expanded within the limited size of the ceramic board 70, and therefore, the voltage breakdown resisting strength has to be increased. Thus conventionally as shown in FIG. 3*a*, an opening 80 is formed, or as shown in FIG. 3*b*, a closed opening 90 and/or an opening 80 is formed, thereby reinforcing the voltage breakdown resisting strength.

FIGS. 3*a* to 3*e* illustrate various examples of the conventional volume board. FIG. 3*a* illustrates a volume board having no central point P but having an opening 80. In FIG. 3*b*, a central point P and a closed opening 90 are formed. In FIG. 3*c*, the central point P serves as a closed opening, and an opening 80 is formed.

FIG. 3*d* illustrates a volume board having a closed opening 90. FIG. 3*e* illustrates a volume board in which two openings 80 covering no central point P are formed near the both ends, and closed openings 90 are formed each at the middle and near the upper end. In the above examples, a sufficient voltage breakdown resisting strength cannot be obtained compared with the provision of the openings from the central point to the edge.

Further, in the case where the above ceramic board 70 having the resistor pattern 60 is used, the inside of the focus unit 10 has to be coated with a soft epoxy resin, and the curing of the resin has to be carried out. Therefore, due to the complicated structure and the complicated manufacturing process, the assemblability and the productivity are extremely aggravated.

SUMMARY OF THE INVENTION

The present invention is intended to overcome the above described disadvantages of the conventional techniques.

Therefore it is an object of the present invention to provide a focus volume of an FBT focus unit, in which when manufacturing the focus volume of the focus unit, a focus ceramic board is separately provided, openings are formed around the central point, and then a volume resistor pattern is printed, so that the size of the volume board is made small but is made to give a reinforced voltage breakdown resisting strength, that the manufacturing process is simplified by excluding the coating of an insulating resin, that the manufacturing process is made easy, and that one ceramic board is used for a small or large volume board so as to standardize the volume board.

It is another object of the present invention to provide a focus volume coupling device for an FBT focus unit, in which the focus volume is isolated into the volume case, so that the focus volume can be easily installed, and that the volume board can be insulated from the bobbins in a sure manner.

In achieving the above objects, the focus volume of an FBT focus unit according to the present invention includes: a volume board installed in the FBT focus unit; a resistor pattern having one or more round portions and formed on the volume board, with a variable contact point moving along the round portion around a central point of the volume slider; an opening formed within each of the round resistor portions; and the opening covering a central contact point of a volume slider, i.e., a center of a virtual circle extending along the round portion of the resistor pattern, and covering a portion of a virtual straight line connecting a starting point and an ending point of the round portion of the resistor pattern.

In another aspect of the present invention, the focus volume of an FBT focus unit according to the present invention includes: a focus volume board installed in the FBT focus unit; a focus resistor pattern having a round portion and formed on the focus volume board, with a variable contact point moving along the round portion around a central point of the focus volume slider; a screen volume board installed in the FBT focus unit; a screen resistor pattern having a round portion and formed on the screen volume board, with a variable contact point moving along the round portion around a central point of the screen volume slider; openings formed respectively within the round focus and screen resistor portions; and the opening covering a central contact point of a volume slider, i.e., a center of a virtual circle extending along the round portions of the focus and screen resistor patterns, and covering a portion of a virtual straight line connecting a starting point and an ending point of the round portions of the focus and screen resistor patterns, and the focus and screen volume boards being separately provided.

In still another aspect of the present invention, the focus volume coupling device of an FBT focus unit according to the present invention includes: a volume board with a resistor pattern printed thereon, the resistor pattern having at least one or more round portions, a variable contact point revolving around a central contact point of a volume slider, and the volume board having an opening within each of the round portions; a volume case having two volume board coupling spaces for receiving the volume board; the volume case having isolating walls to be inserted into the openings of the volume board so as to be protruded above the volume board; and a cover for being coupled with the volume case after inserting the volume board into the volume case.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENTS

Figure 1:
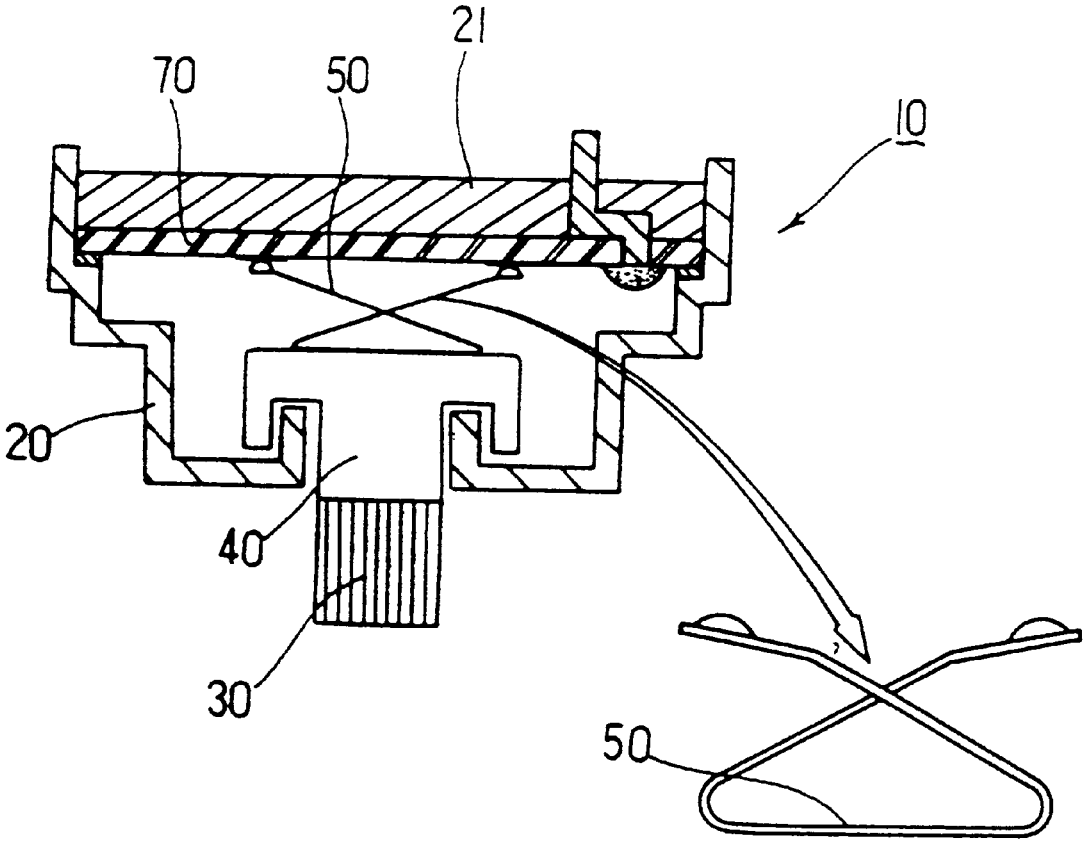
FIG. 1 Prior Art
FIG. 1 is a frontal sectional view of the general focus unit to be installed on a side of an FBT case.
Figure 2:
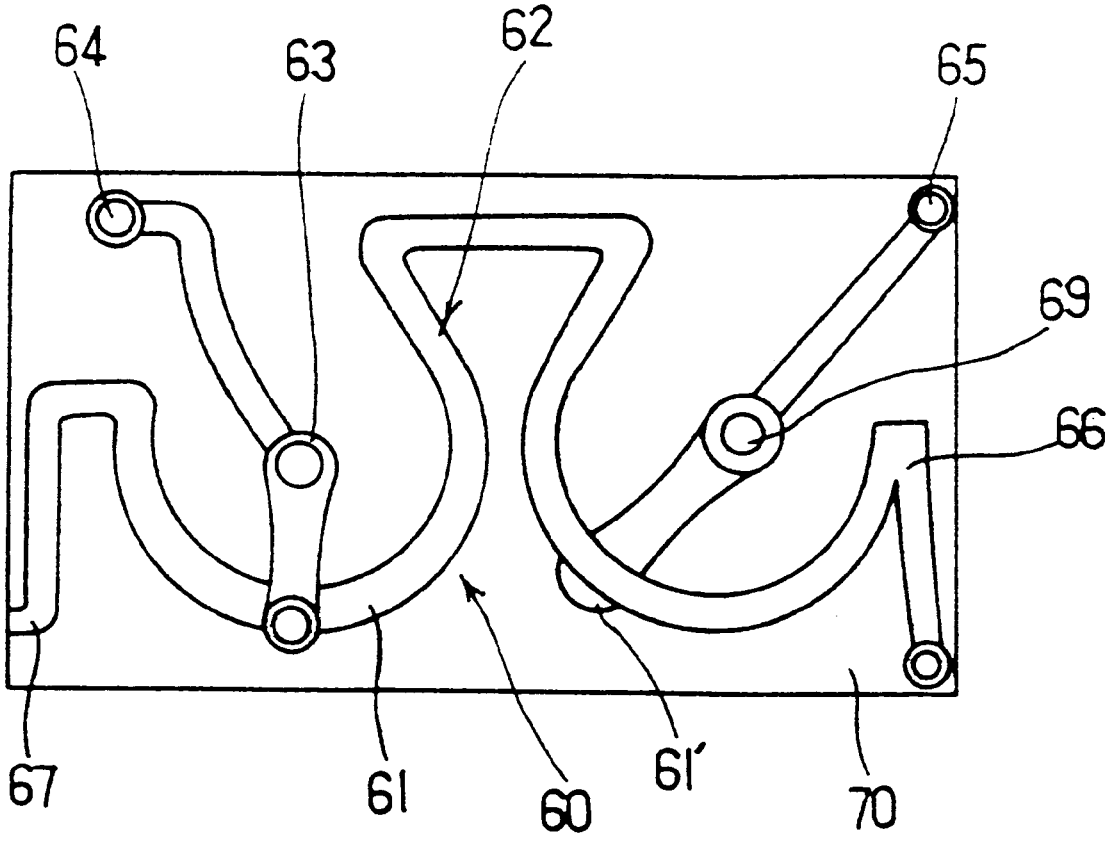
FIG. 2 Prior Art
FIG. 2 schematically illustrates the conventional focus volume board to be installed on a side of an FBT case.
Figure 3A:
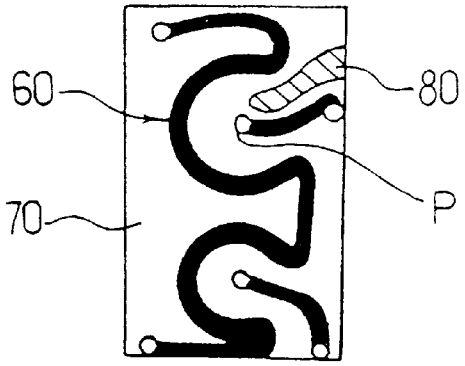
FIG. 3(a) Prior Art
FIGS. 3*a* to 3*e* illustrate other examples of the conventional volume board.
Figure 3B:
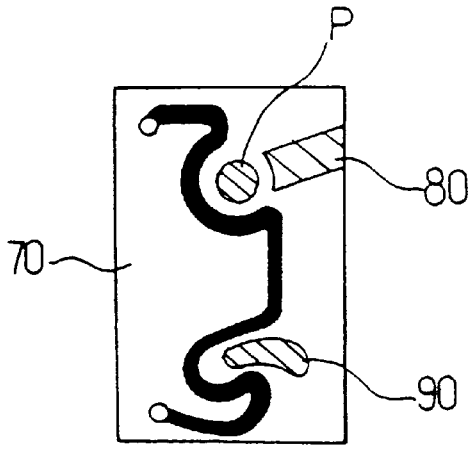
FIG. 3(b) Prior Art
Figure 3C:
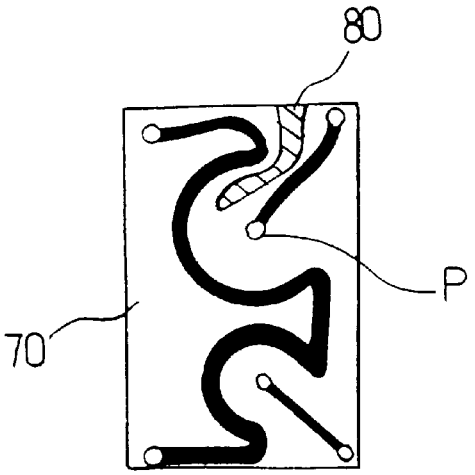
FIG. 3(c) Prior Art
Figure 3D:
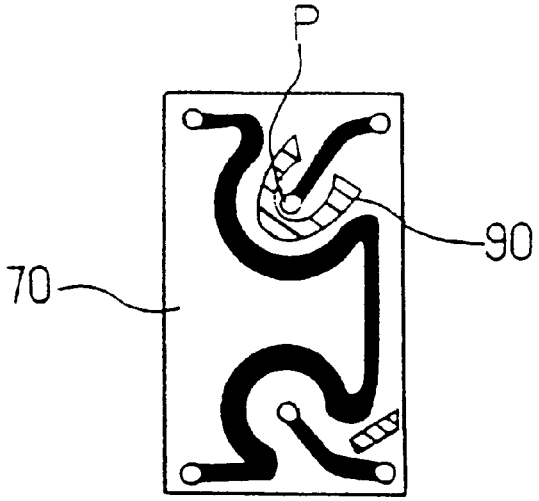
FIG. 3(d) Prior Art
Figure 3E:
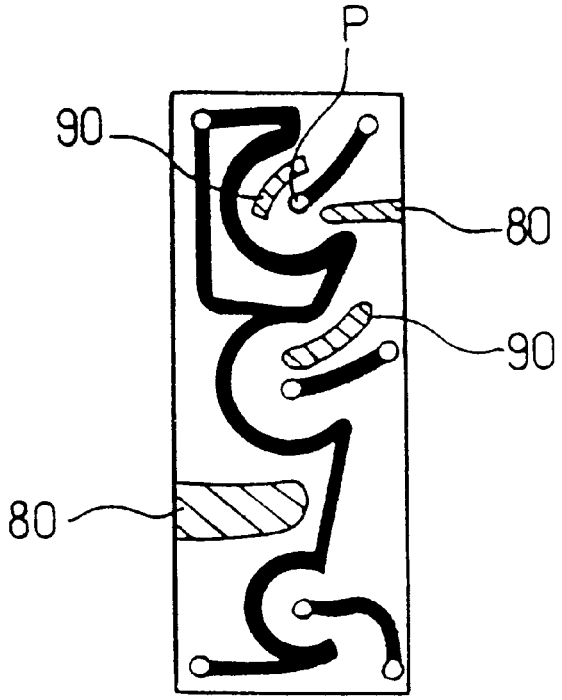
FIG. 3(e) Prior Art
Figure 4:
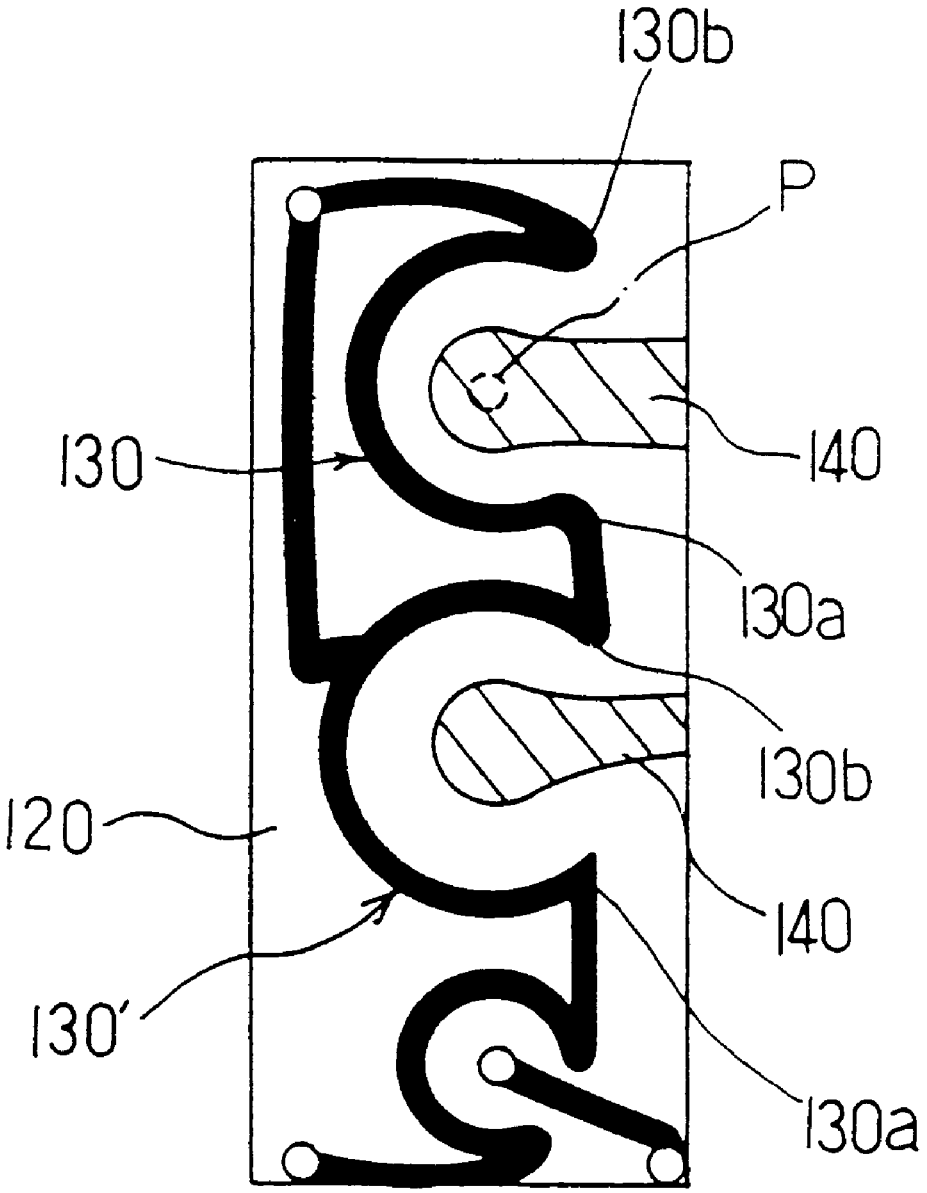
FIG. 4 is a schematic perspective view of the focus volume board according to the present invention.

FIG. 4 is a schematic perspective view of the focus volume board according to the present invention. The focus volume 100 according to the present invention is constituted as follows. That is, a resistor pattern 130 is printed on a volume board 120 which is to be installed on a side of an FBT focus unit 110. The resistor pattern 130 has at least one or more round portions along which a variable contact point revolves around a central contact point P of the round portion. An opening 140 is formed within each of the round portions of the resistor pattern 130.

The opening 140 covers a central contact point P which is the center of a virtual circle which extends along the round portion of the resistor pattern 130. The opening 140 further covers a portion of a virtual straight line which covers a starting point 130*a* and an ending point 130*b* of the round portion of the resistor pattern 130.

Figure 5:
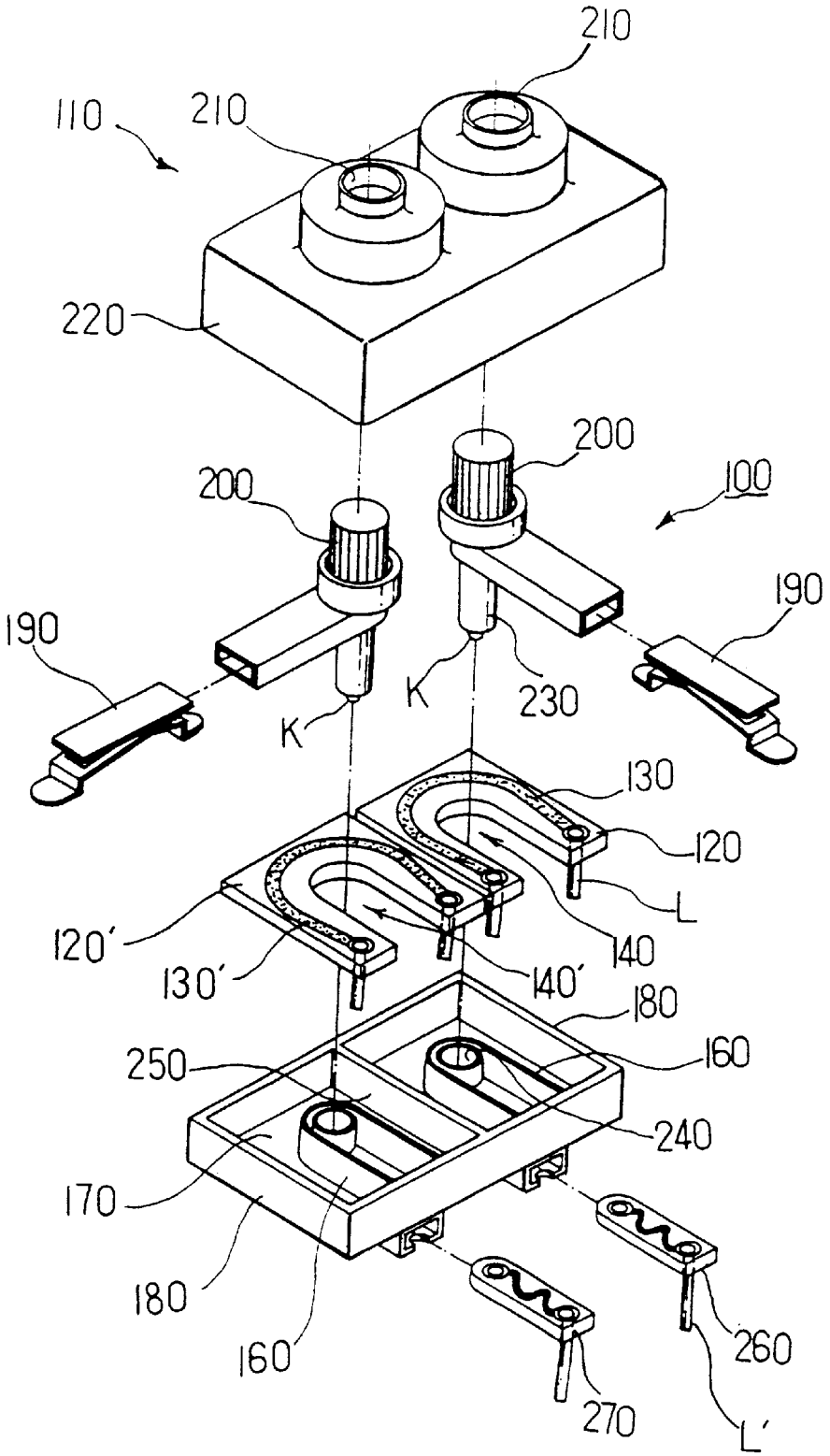
FIG. 5 is an exploded perspective view showing the volume case and another example of the focus volume board and other related parts according to the present invention.

FIG. 5 is an exploded perspective view showing the volume case and another example of the focus volume board and other related parts according to the present invention. A focus resistor pattern 130 is formed on a focus volume board 120, and the focus resistor pattern 130 has a round portion along which a variable contact point moves around the central contact point P of the round portion. A screen resistor pattern 130' is formed on a screen volume board 120', and the screen resistor pattern 130' has a round portion along which a variable contact point moves around the central contact point P of the round portion. Further, openings 140 and 140' are formed within the round portions of the focus and screen resistor patterns 130 and 130'.

Each of the openings 140 and 140' covers a central contact point P which is the center of a virtual circle which extends along the round portion of the resistor patterns 130 and 130'. Each of the openings 140 and 140' further covers a portion of a virtual straight line which connects a starting point 130*a* and an ending point 130*b* of the round portion of the resistor patterns 130 and 130'. In this manner, the volume boards 120 and 120' are open, and the focus and screen volume boards 120 and 120' are separately provided.

A volume case 180 has volume board coupling spaces 170 for receiving the volume boards 120 and 120', and has isolating walls 160 which are inserted into the openings 140 and 140' and which have a height greater than the thickness t of the volume board 120 to be protruded above it.

The volume case 180 is coupled with a cover 220 through which a pair of actuation knobs 200 having sliders 190 pass. That is, the actuation knobs 200 respectively pass through a pair of knob coupling holes 210.

Within the isolating walls 160 of the volume case 180, there is formed a pair of shaft coupling holes 240 through which volume shafts 230 are respectively inserted. The volume case 180 has a partitioning wall 250 to form two interiors within which the focus and screen volume boards 120 and 120' are respectively accommodated. To the bottom of the volume case 180, there are connected a focus output terminal 260 and a screen output terminal 270 which are respectively connected to the volume shafts 230.

The present invention constituted as above will now be described as to its action and effects.

As shown in FIG. 4, The resistor pattern 130 is printed upon the volume board 120 of the focus volume, thereby completing the formation of the resistor pattern 130. Here, the resistor pattern 130 includes at least one or more round portions along which the variable contact point moves around the central contact point P.

Then an opening 140 is formed within each of the round portions of the resistor pattern 130. The opening 140 covers a central contact point P which is the center of a virtual circle which extends along the round portion of the resistor pattern 130. The opening 140 further covers a virtual straight line which connects a starting point 130*a* and an ending point 130*b* of the round portion of the resistor pattern 130. Thus the volume board 120 is open.

The contour of the opening 140 of the volume board 120 may be arcuate or rectangular, and the opening 140 covers the central point of the round portion of the resistor pattern 130 and also covers a part of a virtual straight line connecting the starting and ending points of the round portion of the resistor pattern 130. In this manner, the opening 140 is formed by cutting away the edge of the volume board 120 which is made of a ceramic material. Under this condition, the starting point 130*a* and the ending point 130*b* of the round portion of the resistor pattern 130 may be changed with each other.

Meanwhile, the present invention provides another embodiment of the focus volume board which is to be inserted into the volume case of FIG. 5. In this embodiment, a focus resistor pattern 130 is formed upon a volume board 120 of a focus volume 100 which is to be installed in the focus unit 110 of the FBT case 150. A variable contact point moves along the round portion of the resistor pattern 130 around the central contact point P. Separately to this, a screen resistor pattern 130' is formed upon a screen volume board 120'. A variable contact point moves along the round portion of the screen resistor pattern 130' around the central contact point P.

Within the round portions of the focus and screen resistor patterns 130 and 130', there are respectively formed openings 140 and 140'. Each of the openings 140 and 140' covers a central contact point P which is the center of a virtual circle which extends along the round portion of the resistor patterns 130 and 130'. Each of the openings 140 further covers a part of a virtual straight line which connects a starting point 130*a* and an ending point 130*b* of the round portion of the resistor patterns 130 and 130'. Thus the volume board 120 and 120' are respectively open.

Figure 6:
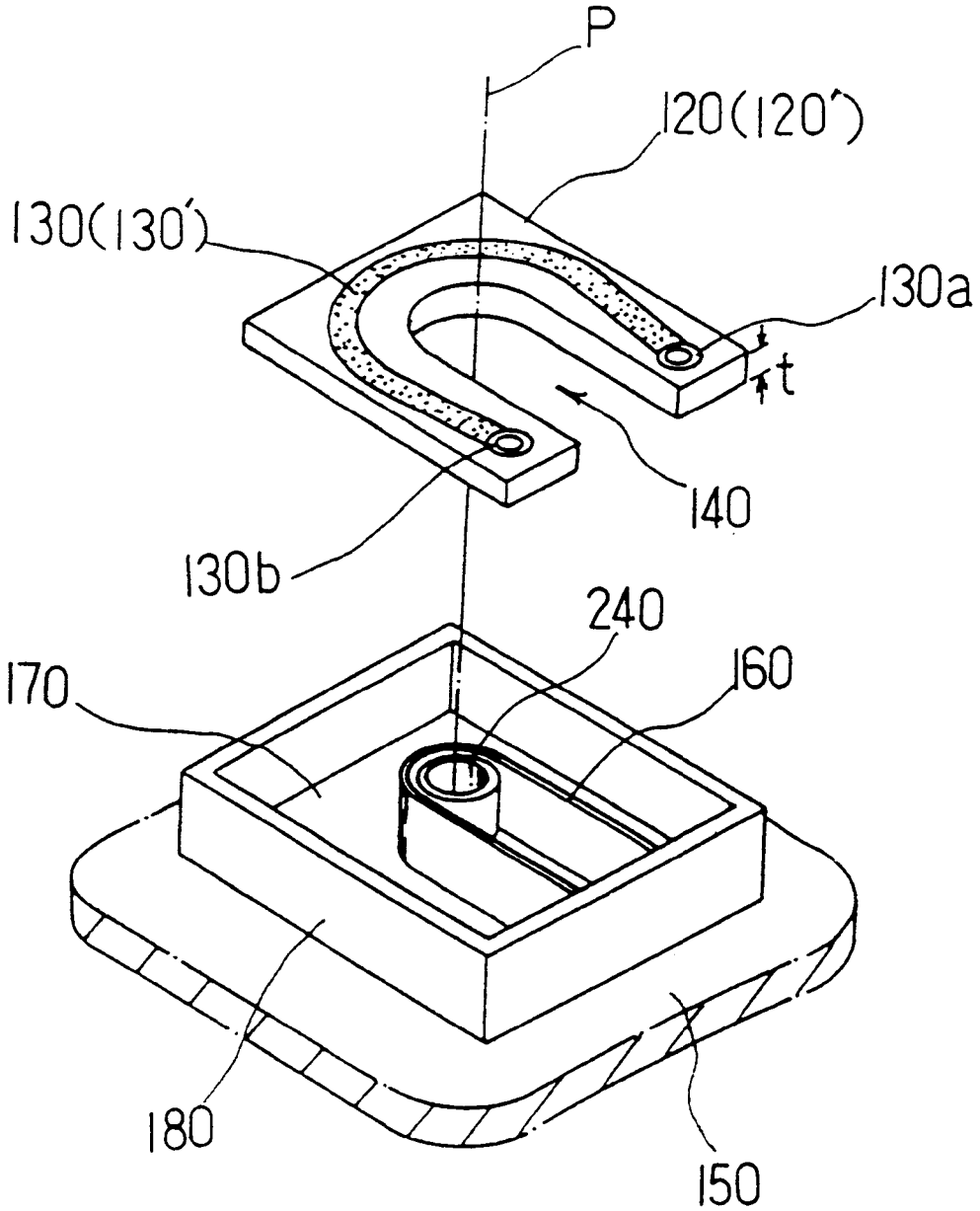
FIG. 6 is a perspective view showing the focus volume case and the volume board according to the present invention.

In order to draw the focus and screen voltages, the volume board 120 can be formed in two separate pieces as shown in FIGS. 5 and 6. In order to accommodate these volume boards 120 and 120', the volume case 180 is formed such that two partitions are made to receive the volume boards 120 and 120'.

As shown in FIG. 5, the volume case 180 has isolating walls 160 within the internal spaces 170 of it so as for the isolating walls 160 to be inserted into the openings 140 and 140'. A cover 220 is coupled to the volume case 180, with the actuation knobs 200 passing through the cover 220. Thus the cover 220 protects the volume board 120, and therefore, the volume board 120 can be sufficiently insulated even without filling an insulating resin into the volume case 180.

Particularly, a slider 190 having two contacts is installed within each of the actuation knobs 200. A volume shaft 230 extends down from each of the actuation knobs 200, and the volume shafts 230 are inserted respectively into the isolating walls 160 of the volume case 180.

As shown in FIG. 5, the volume case 180 has a partitioning wall 250 to partition the internal space of the volume case 180 into two parts, so that the two volume boards 120 and 120' can be received into the two partitions. Therefore, the voltage breakdown resisting strength can be maximized. On the bottom of the volume case 180, there are secured the focus output terminal 260 and the screen output terminal 270 which are respectively connected to the volume shafts 230. Thus if the actuation knobs 200 are turned, the contact points of the slider 190 moves along the round portions of the resistor pattern 130.

Thus an input voltage is supplied through a focus input lead L of the resistor pattern 130, and an adjusted output voltage is outputted through a focus output lead L' of the focus output terminal 260. Under this condition, between the starting point 130*a* and the ending point 130*b* of each of the focus and screen resistor patterns 130 and 130', there is the opening 140 or 140' with the isolating wall 160 inserted into it. Therefore, the insulation between the starting point 130*a* and the ending point 130*b* becomes very strong.

Further, the sliders 190 which are contact point springs are secured to the volume shafts 230 in an insulated state, and therefore, there is a strong insulating distance between the exposed portion of the slider 190 and the other resistor pattern 130. Further, also a strong insulating distance is secured between a lowermost tip K of the volume shaft 230 and the round resistor pattern 130, thereby ensuring all the necessary insulations.

According to the present invention as described above, when manufacturing the focus volume of the focus unit, a focus ceramic board is separately provided, openings are formed around the central point, and then a volume resistor pattern is printed, so that the size of the volume board is made small but is made to give a reinforced voltage breakdown resisting strength, that the manufacturing process is simplified by excluding the coating of an insulating resin, that the manufacturing process is made easy and is made of low cost, and that one ceramic board is used for a small or large volume board so as to standardize the volume board.

In the above, the present invention was described based on the specific drawings, but it should be apparent to those ordinarily skilled in the art that various changes and modifications can be added without departing from the spirit and scope of the present invention which are defined in the appended claims.

What is claimed is:

1. An FBT focus unit, comprising:

a volume board;

a resistor pattern having at least one round portion and formed on said volume board, with a variable contact point moving along said round portion around a central point of said round portion;

an opening formed within said round resistor portion; said opening covering a central contact point of a volume slider, i.e., a center of a virtual circle extending along said round portion of said resistor pattern, and covering a portion of a virtual straight line connecting a starting point and an ending point of said round portion of said resistor pattern;

a volume case having at least one volume board coupling space in which said volume board is received; said volume case having an isolating wall inserted into said opening of said volume board so as to protrude above said volume board; and a cover coupled with said volume case.

2. The focus unit as claimed in claim 1, wherein said opening of said volume board is disposed perpendicularly to an axis of said volume shaft, and covers a center of said round portion of said resistor pattern, and also covers a part of a virtual straight line connecting a starting point and an ending point of said round portion of said resistor pattern, said opening being formed by cutting away said volume board.

3. The focus volume as claimed in claim 2, wherein said opening of said volume board is formed within said round portion of said resistor pattern.

4. The focus unit as claimed in claim 1, wherein said opening of said volume board has a pre-designed shape.

5. The focus unit as claimed in claim 1, wherein said opening of said volume board is formed within said round portion of said resistor pattern.

6. The focus unit as claimed in claim 1, wherein said volume board with said resistor pattern printed thereon is made of a ceramic material.

7. An FBT focus unit, comprising:

a focus volume board;

a focus resistor pattern having a round portion and formed on said focus volume board, with a variable contact point moving along said round portion around a central point of said focus round portion;

a screen volume board;

a screen resistor pattern having a round portion and formed on said screen volume board, with a variable contact point for moving along said round portion around a central point of said screen round portion;

openings formed respectively within said round focus and screen resistor portions;

said openings each covering a central contact point of a respective volume slider, i.e., a center of a virtual circle extending along the respective round portion of said focus and screen resistor patterns, and covering a portion of a virtual straight line connecting a starting point and an ending point of the respective round portion of said focus and screen resistor patterns, and said focus and screen volume boards being separately provided;

a volume case having volume board coupling spaces in which said volume boards are received; said volume case having isolating walls inserted into said openings of said volume boards so as to protrude above said volume boards, respectively; and a cover coupled with said volume case.

8. The focus unit as claimed in claim 7, wherein said opening of each said volume board has a pre-designed shape.

9. The focus volume as claimed in claim 8, wherein said opening of said volume board is formed within said round portion of said resistor pattern.

10. The focus unit as claimed in claim 7, wherein said opening of each said volume board is formed within said round portion of said resistor pattern.

11. The focus unit as claimed in claim 7, wherein said cover coupled to said volume case has a pair of knob coupling holes for passage of sliders therethrough, each said slider having a central contact point and a variable contact point.

12. The focus unit as claimed in claim 7, wherein said isolating walls of said volume case respectively have a shaft coupling hole for receiving a volume shaft.

13. The focus unit as claimed in claim 7, wherein said volume case has a partitioning wall for partitioning an interior of said volume case into said coupling spaces for receiving said focus and screen volume boards.

14. The focus unit as claimed in claim 7, wherein a focus output terminal and a screen output terminal are secured to a bottom of said volume case and respectively connected to lower tips of said volume shafts.

* * * * *